US006968947B2

(12) United States Patent
Johnson

(10) Patent No.: US 6,968,947 B2
(45) Date of Patent: Nov. 29, 2005

(54) SHIPPING OF LIVE PLANTS WITH PERFORATED PLASTIC OVERWRAP

(75) Inventor: Bradford T. Johnson, Palmetto, FL (US)

(73) Assignee: International Paper Company, Stamford, CT (US)

( * ) Notice: Subject to any disclaimer, the term of this patent is extended or adjusted under 35 U.S.C. 154(b) by 17 days.

(21) Appl. No.: 10/245,567

(22) Filed: Sep. 18, 2002

(65) Prior Publication Data

US 2004/0050736 A1 Mar. 18, 2004

(51) Int. Cl.[7] ..... B65D 85/52

(52) U.S. Cl. ..... 206/423; 206/497; 206/499; 206/594

(58) Field of Search ..... 206/423, 497, 206/499, 591, 593, 594

(56) References Cited

U.S. PATENT DOCUMENTS 3,922,362 A 11/1975 Pierce
4,333,267 A * 6/1982 Witte ..... 47/84
4,869,599 A * 9/1989 Allen ..... 383/38
4,941,572 A * 7/1990 Harris ..... 206/423
5,141,149 A * 8/1992 Fulton ..... 229/103
5,239,775 A * 8/1993 Landau ..... 47/72
5,427,240 A * 6/1995 Holtkamp, Jr. ..... 206/423
5,698,249 A 12/1997 Hayashi et al.
5,871,147 A * 2/1999 Smith et al. ..... 229/167
6,294,210 B1 9/2001 Kuo

* cited by examiner

*Primary Examiner*—Jacob K. Ackun, Jr.

(57) ABSTRACT

The shipping system envelopes plants within their containers in perforated plastic. The perforations of the plastic are sized and spaced to allow respiration but to prevent the plant from becoming dislodged from their container. The container can be a tray having multiple cells holding a plurality of plants, or a single pot. The perforated plastic is used as an over wrap of the plant within its container. The plants are placed within a shipping container. Inserts are placed within the container and prevent the plant from becoming crushed if the shipping container becomes inverted by supporting the edge of the plant container and preventing the plant material from contacting any surface which would damage the plant.

14 Claims, 3 Drawing Sheets

SHIPPING OF LIVE PLANTS WITH PERFORATED PLASTIC OVERWRAP

FIELD OF THE INVENTION

The invention pertains to the packing and shipping of live plants.

BACKGROUND OF THE INVENTION

Growers shipping their products to distant places encountered the difficulty of having the live plants arrive both alive and without damage. Damage occurs when the plants, and/or the growing medium, becomes dislodged from the containers. This is especially a problem when the shipping container becomes inverted during transportation. When inverted, the weight of the containers crushes the plants so that upon arrival the plants are no longer usable.

The present solution is to offer credits and rebates for the plants damaged during shipping. Previous attempts at shipping live products have included the use of plastic overwrap. This approach has the drawback that live plants need exposure to air and sealing them with plastic does not allow respiration necessary for live plants. Another approach has been to use a plastic netting to hold the plants within their containers. Netting has proved insufficient in that plants are still able to fit within holes in the netting and become damaged.

There is a need in the art for a system for shipping live plants that protects plants from becoming dislodged from their containers and prevents crushing of the plants if the container becomes inverted during shipping.

It is an object of the invention to provide a system for shipping live plants.

It is another object of the invention to provide a covering for plants within containers maintaining the plant within the container but allowing for respiration.

It is another object of the invention to provide a shipping system preventing crushing of plants when the shipping container is inverted.

It is another object of the invention to provide a shipping system for live plants minimizing the loss of plants during shipping.

It is still another object of the invention to provide a shipping system which is simple and inexpensive to use.

It is yet another object of the invention to provide a shipping system for live plants that safely ships a multitude of plants simultaneously.

These and other objects of the invention will become apparent to one of ordinary skill in the art after reviewing the disclosure of the invention.

SUMMARY OF THE INVENTION

The shipping system envelopes plants within their containers in perforated plastic. The perforations of the plastic are sized and spaced to allow respiration but to prevent the plant from becoming dislodged from their container. The container can be a tray having multiple cells holding a plurality of plants, or a single three inch pot. The perforated plastic is used as an over wrap of the plant within its container. The plants are placed within a shipping container. Inserts are placed within the container and prevent the plant from becoming crushed if the shipping container becomes inverted by supporting the edge of the plant container and preventing the plant material from contacting any surface which would damage the plant.

DETAILED DESCRIPTION OF THE INVENTION

Figure 1:
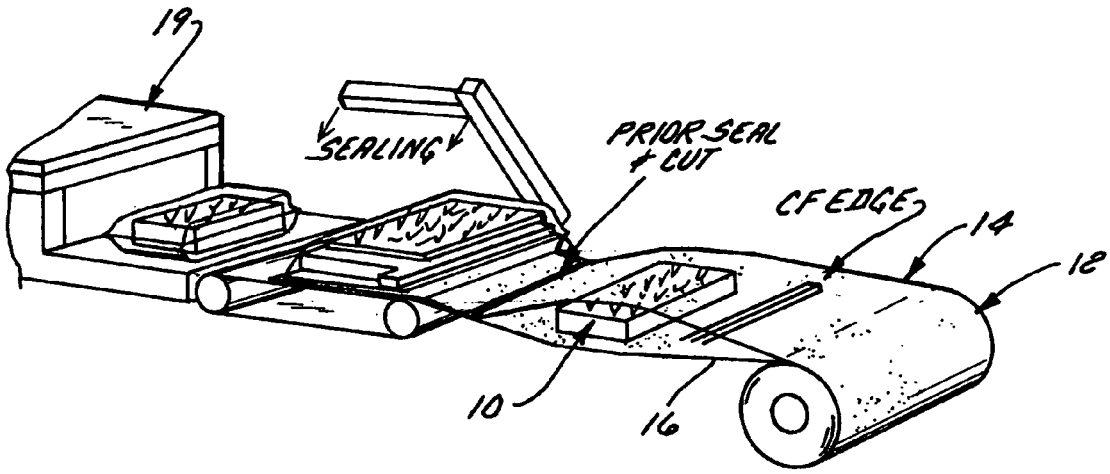
FIG. 1 is a view of the over wrapping of a plant container.
Figure 1A:
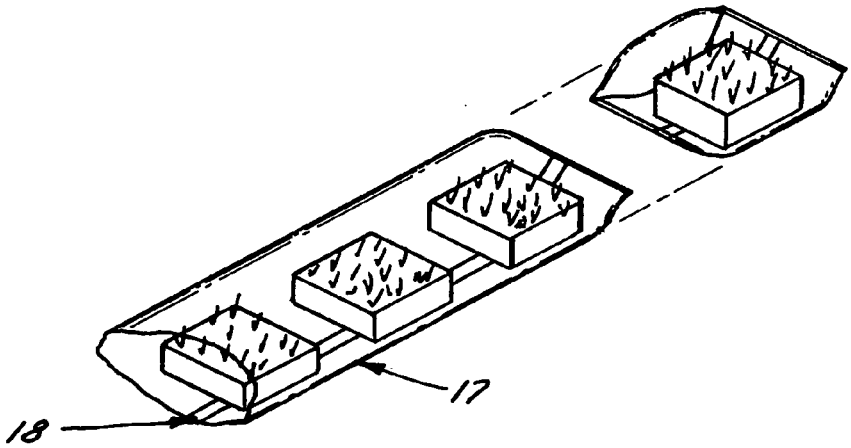
FIG. 1*a* is an alternative method of overwrapping trays.

Shipping of live plants starts with the wrapping of the plant in its container with perforated plastic. This is depicted in FIG. 1 as it is seen a roll of perforated plastic 12 is used to completely envelope the tray having a plurality of cells, each cell holding a single plant. As shown in FIG. 1, the tray 10 is placed between two layers of film 14, 16. A sealing bar connects the four edges of the film about the tray. Alternatively, a single sheet of plastic 17 can be wrapped about the tray. The edges of the sheet are overlapped and a longitudinal seam 18 is formed, as seen in FIG. 1*a*. If a tube of perforated plastic is used, there is no need to form a longitudinal seam.

The film is perforated to allow respiration of the live plants. The size and spacing of the perforations, while allowing for respiration, provide enough support to maintain the plant within its container throughout the shipping process. As used herein, the term perforated plastic is distinct from plastic netting. The plastic is a heat shrink film, such as polypropylene, polyethylene, or polyolefin, to allow for the sizing of the film about the container to form a snug fitted sheet that protects the plants from movement during shipping. After wrapping the container with plastic, the container is passed through a 380° F. shrink tunnel 19. The temperature can be adjusted to shrink the plastic to any tray dimension or plant height.

The trays with the overwrapped plastic are placed within shipping containers. The shipping containers contain inserts which contact the edge of the tray. The inserts support the tray by the edges in the event of the shipping container becoming inverted.

Figure 2:
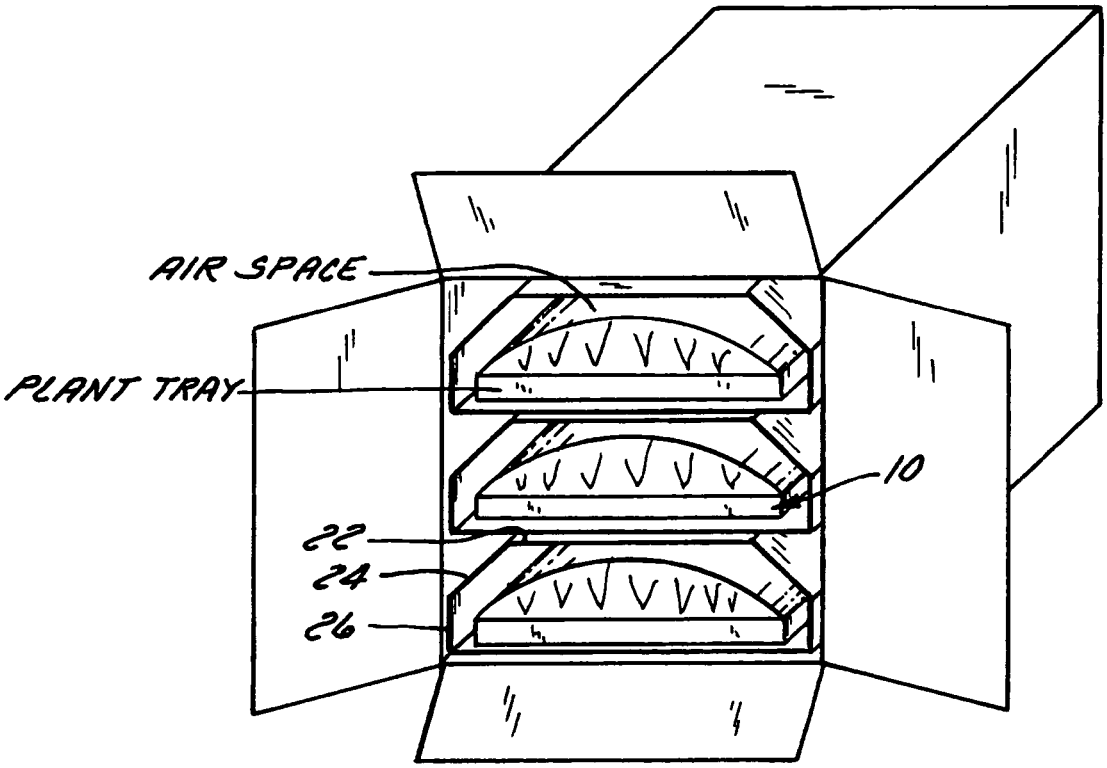
FIG. 2 is a view of the plant container within a shipping container having an insert.

FIG. 2 shows a shipping container for holding a plurality of overwrapped trays. In the depiction of FIG. 2, three trays are stacked within end loaded carton. Each carton has a insert to protect the overwrapped container from damage. Each insert consists of a bottom panel with two upstanding side panels 26. Extending from each of the side panels is an angled panel 24 terminating in a top panel 22. It is the angled panels that engage the side edges of the overwrapped containers to prevent their movement in the event of the carton becoming inverted. Inserts provided air space above each overwrapped container to provide for plant respiration. Each insert supports the insert above it and the trays remain in their original spaced relation.

Figure 3:
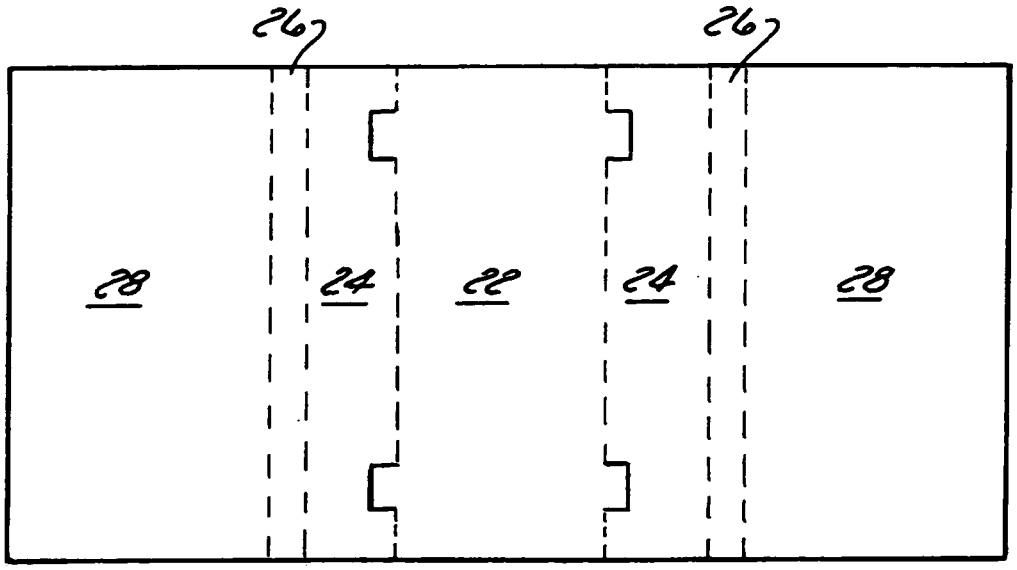
FIG. 3 is a view of a blank made for the insert of FIG. 2.

The blank for forming the insert of the embodied carton is shown in FIG. 3. The blanks of a top panel 22 foldably join to a pair of angled panels 24. Each angled panel is attached to a relatively short side panels 26. A pair of bottom panels is foldably connected to the side panels 26. The bottom panels 28 overlap and are joined to one another to form a structurally sound insert able to support several loaded inserts above it.

Figure 4:
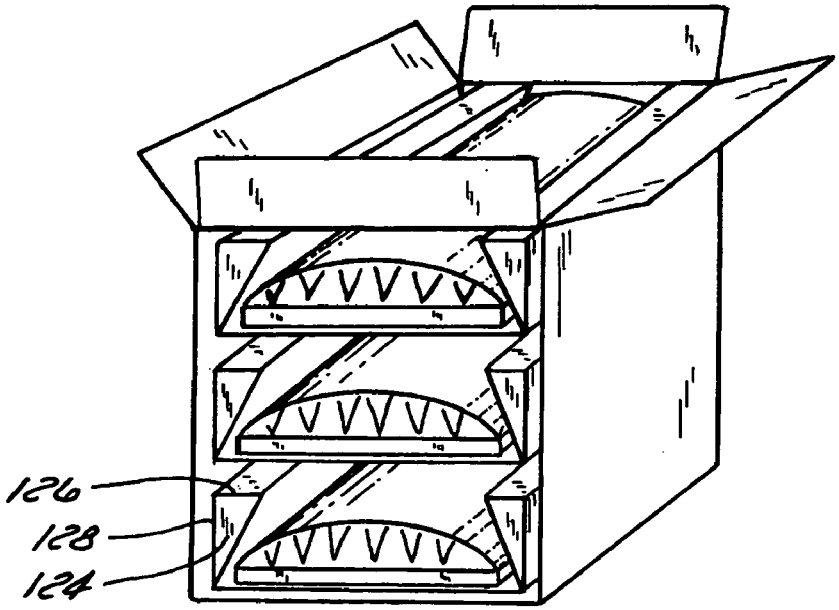
FIG. 4 is an alternate view of the shipping container having inserts.

FIG. 4 shows an alternative embodiment of the carton used to ship a plurality of overwrapped containers. The embodiment is a top loaded carton having a different type of insert. The end wall is not shown in order to illustrate the details of the insert. The insert has a bottom panel 122 foldably connected to a pair of angled side walls 124. A top panel 126 extends from the top edge of the angled side walls and a pair of side walls 128 extend downwardly from the top wall to create a triangle shaped post extending upwardly from the bottom panel. Several of these trays can be stacked upon one another and, similar to the other embodiment, the angled side walls engage the edges of the plant containing trays to secure them in place in the event of the carton becoming inverted. Also, the triangular shaped post create air space to allow for plant respiration.

Figure 5:
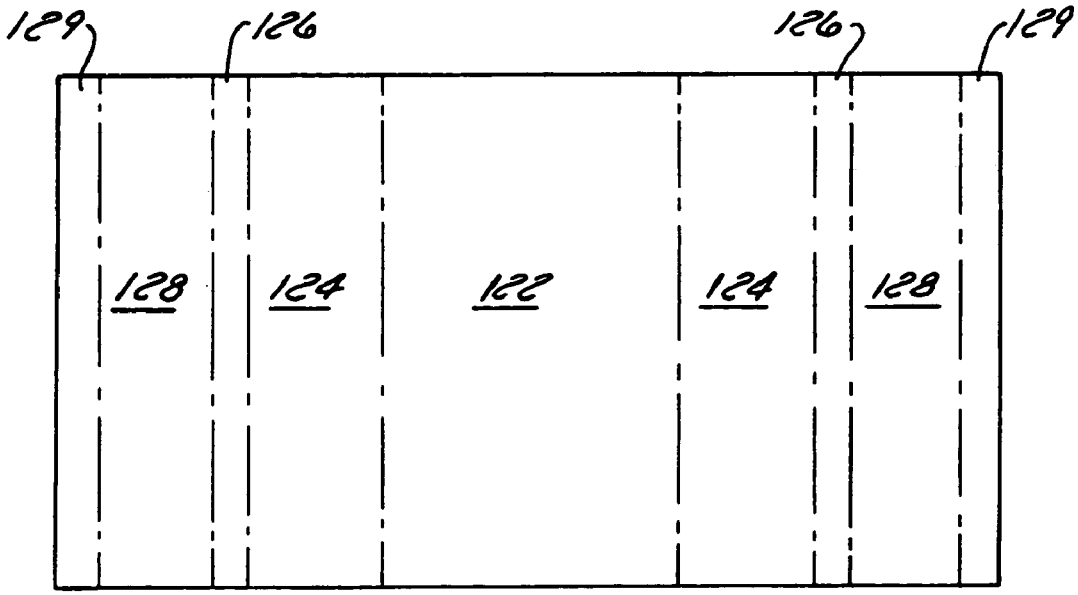
FIG. 5 is a view is a blank of the insert made for the box of FIG. 4.

The blank used to make the insert of FIG. 4 is shown in FIG. 5. The blank has a bottom panel 122 connected to a pair of angled side walls 124. A pair of top panels 126 is foldably connected to the angled side walls and have a pair of side walls 128 foldably connected to the opposite side of the top wall. A glue panel 129 is connected to the edge of each side panel 128 to secure the insert in its erected condition and provide a structurally sound insert able to support other inserts on top of it.

While the invention has been described with reference to preferred embodiment, variations and modifications would be apparent to one of ordinary skill in the art. The invention encompasses such variations and modifications and are defined by the appended claims.

I claim:

1. A shipping system comprising:

a shipping carton, at least one insert in said shipping carton, said insert having a pair of angled sidewalls, a container, said container containing live plant material, wherein said angled sidewalls engage said container to maintain said container in space relationship with said shipping carton, wherein said insert comprises a bottom wall, a pair of sidewalls extending upwardly from opposite edges of said bottom wall, said pair of angled sidewalls extending from said pair of sidewalls, said angled sidewalls converging towards each other, and a top wall extending between said pair of angled sidewalls.

2. The shipping system of claim 1, wherein said container is a three inch pot.

3. The shipping system of claim 1, wherein said containers a tray having as plurality of cells, each cell having a live plant.

4. The shipping system of claim 1, wherein said plastic is heat shrunk plastic.

5. The shipping system of claim 1, further comprising a plurality of inserts in said shipping carton.

6. The shipping system of claim 1, wherein said angled sidewalls engage the periphery of said container.

7. The shipping system of claim 1, further comprising a perforated plastic overwrap on said container.

8. A shipping system comprising:

a shipping carton, at least one insert in said shipping carton, said insert having a pair of angled sidewalls, a container, said container containing live plant material, wherein said angled sidewalls engage said container to maintain said container in space relationship with said shipping carton, wherein said insert comprises a bottom wall, said pair of angled sidewalls extending upwardly from said bottom wall and converging toward one another, a top wall extending from each angled sidewalls and a sidewall extending from between each top wall and said bottom wall.

9. The shipping system of claim 8, further comprising a plurality of inserts in said shipping carton.

10. The shipping system of claim 8, wherein said angled sidewalls are adapted to engage the periphery of said container when positioned in said carton.

11. The shipping system of claim 8, further comprising a plastic overwrap for enveloping said container positioned in said carton.

12. The shipping system of claim 11 wherein said overwrap is perforated.

13. The shipping system of claim 8, wherein said insert comprises a bottom wall, a pair of sidewalls extending upwardly from opposite edges of said bottom wall, said pair of angled sidewalls extending from said pair of sidewalls, said angled sidewalls converging towards each other, and a top wall extending between said pair of angled sidewalls.

14. The shipping system of claim 8, wherein said insert comprises a bottom wall, said pair of angled sidewalls extending upwardly from said bottom wall and converging toward one another, a top wall extending from each angled sidewalls and a sidewall extending from between each top wall and said bottom wall.

* * * * *